United States Patent [19]

Langowski

[11] 4,030,746

[45] June 21, 1977

[54] PIPE HANDLING HEAD

[75] Inventor: Faustyn Cornell Langowski, Houston, Tex.

[73] Assignee: BJ-Hughes Inc., Long Beach, Calif.

[22] Filed: Apr. 26, 1976

[21] Appl. No.: 680,301

[52] U.S. Cl. ..... 294/88; 214/2.5; 294/106

[51] Int. Cl.[2] ..... B66C 1/10; E21B 19/00

[58] Field of Search ..... 294/88, 90, 106, 113, 294/115; 214/1 P, 1 BD, 1 CM, 2.5, 3, 147 G, 652, 653

[56] References Cited

UNITED STATES PATENTS

| | | | |
|---|---|---|---|
| 2,814,396 | 11/1957 | Neale | 214/147 G X |
| 3,038,620 | 6/1962 | Collin | 214/147 G |
| 3,147,993 | 9/1964 | Broderson et al. | 294/88 |
| 3,325,029 | 6/1967 | Rigsby | 214/653 |
| 3,651,966 | 3/1972 | Willett | 214/147 G |
| 3,888,317 | 6/1975 | Walters | 214/147 G X |
| 3,937,515 | 2/1976 | Langowski | 294/88 |

FOREIGN PATENTS OR APPLICATIONS

| | | | |
|---|---|---|---|
| 2,000,760 | 7/1971 | Germany | 294/88 |
| 184,103 | 6/1963 | Sweden | 214/147 G |

*Primary Examiner*—Johnny D. Cherry
*Attorney, Agent, or Firm*—John O. Evans, Jr.

[57] ABSTRACT

A head for grasping and guiding a length of pipe, such as marine riser pipe. The head has a base, a body pivoted to the base, and a pair of latch arms pivoted to the body for grasping and releasing the pipe. Power actuated means are provided for pivoting the body on its pivot. Power actuated means are provided for pivoting the latch arms between open and closed positions. The power operated means may embody features that adapt the head to the requirements of grasping and guiding a length of riser pipe suspended from hoisting equipment by a cable and being drawn into a derrick.

19 Claims, 9 Drawing Figures

5
5
6
6

46
128'
42
37
44
58'
36
87'
95'
90
94'
56
23
24
29
66
34
33
65
38
64
59
35
72
61
71
62
63
52
97
88
94
92
95
87
43
45
128
131
41

46
128'
44
42
114'
115'
54
53
51
117
119
118
116
49
52
114
115
41
121
122
107
89
127
126
36
132
123
37
43
45
128
131
129

PIPE HANDLING HEAD

BACKGROUND OF THE INVENTION

1. Field of the Invention

This invention relates to a head for grasping and guiding a length of pipe, such as marine riser pipe, particularly to stabilize the length of pipe when suspended by a cable secured to a derrick hook and to one end of the length of pipe.

2. Description of the Prior Art

U.S. Pat. No. 3,561,811, issued Feb. 9, 1971, J. W. Turner, Jr., "Well Pipe Racker" discloses pipe handling equipment associated with the derrick of a well drilling ship. The lowermost pipe handling assembly of the Turner patent is described as casing manipulating apparatus.

Marine riser pipe is pipe of large diameter that extends from well head equipment on the floor of the ocean up through the water and terminates above the surface of the water within the moon hole of a drilling ship. The drill string is lowered through the riser pipe into the well therebelow when the well is being drilled. Small diameter control lines are secured longitudinally along the exterior of the riser pipe, and the riser pipe may be covered with a resilient flotation or buoyant material which also covers the control lines. Casing may also be run through the riser pipe.

The riser pipe is made up of convenient lengths that are coupled together. When running riser on a drill ship, the riser lengths are hung by a length of cable from the hook of the hoisting equipment with the lower end of the riser length hanging free. Owing to the motion of the ship, the lower end has a pendulum action which is dangerous to men and equipment.

SUMMARY

The pipe stabilizing head of the present invention may be attached to an arm mounted near the derrick floor for horizontal movements. Exemplary of such a movable arm is the arm of the lowermost pipe handling assembly of the foregoing Turner patent. Of course, other movable arm devices may also be employed. As a length of marine riser is being brought up into the derrick through the vee door while suspended from a cable, the stabilizing head of this invention is moved by the arm and actuated to grasp the length of riser near its lower end, and is thereafter moved by the arm to guide the lower end of the riser length to a position from which it can be coupled to the top of the riser string. The head is constructed and arranged to follow the changing angle of inclination of the riser length as it is being moved and to permit the riser length to slide in the head. The stabilizing head of the invention may also be used in dismantling the riser string.

In accordance with the invention, there is provided a head for grasping and guiding a length of pipe which comprises: a base, a body, first pivot means for pivotally mounting the body on said base, first power actuated means for pivoting the body on the first pivot means, a pair of latch arms, each having a proximal end and a distal end, other pivot means for mounting the latch arms by their proximal ends on the body in opposed relation to one another for pivotal movements between closed positions and open positions, and second power actuated means for pivoting the latch arms between the open and closed positions, wherein the second power actuated means for pivoting the latch arms comprises: double acting hydraulic piston-cylinder means operatively associated with the latch arms and adapted to move the latch arms between the closed positions and the open positions, first hydraulic fluid conduit means for supplying hydraulic fluid pressure to the piston-cylinder means to cause the latter to pivot the latch arms to closed positions, second hydraulic fluid conduit means for supplying hydraulic fluid pressure to the piston-cylinder means to cause the latter to pivot the latch arms to open positions, and pilot check valve means in said first conduit means for maintaining hydraulic fluid pressure in the piston-cylinder means, including means responsive to hydraulic fluid pressure in the second conduit means for opening the pilot check valve means.

Further in accordance with the invention, there is provided a head for grasping and guiding a length of pipe which comprises: a base, a body, first pivot means for pivotally mounting the body on the base, first power actuated means for pivoting the body on the first pivot means, a pair of latch arms, each having a proximal end and a distal end, other pivot means for mounting the latch arms by their proximal ends on the body in opposed relation to one another for pivotal movements between closed positions and open positions, and second power actuated means for pivoting the latch arms between the open and closed positions, wherein the first power actuated means for pivoting the body on the first pivot means comprises: a double-acting pneumatic piston-cylinder means operatively associated with the body and adapted to rotate the body in opposite directions, the piston-cylinder means having a head chamber and a rod chamber on opposite sides of its piston, the chambers when respectively pressurized effecting rotation of the body in opposite directions, first conduit means including first valve means selectively operable to admit pressurized gas to one of the chambers while permitting gas simultaneously to be exhausted from the other of the chambers, to admit pressurized gas to the other of the chambers while permitting gas simultaneously to be exhausted from the one chamber, and to block the flow of gas from both said chambers, and second conduit means including second valve means selectively operable to simultaneously open both the chambers to atmosphere and to simultaneously isolate both the chambers from atmosphere.

The power actuated means for pivoting the latch arms and for pivoting the body on its pivot include additional features important to the invention which will be described more fully hereinafter. Still another advantageous features of the invention will be set forth in or be apparent from the description as it proceeds.

BRIEF DESCRIPTION OF THE DRAWINGS

In the drawings, in which like reference characters refer to corresponding parts in the several views.

DESCRIPTION OF THE PREFERRED EMBODIMENTS

Figure 1:
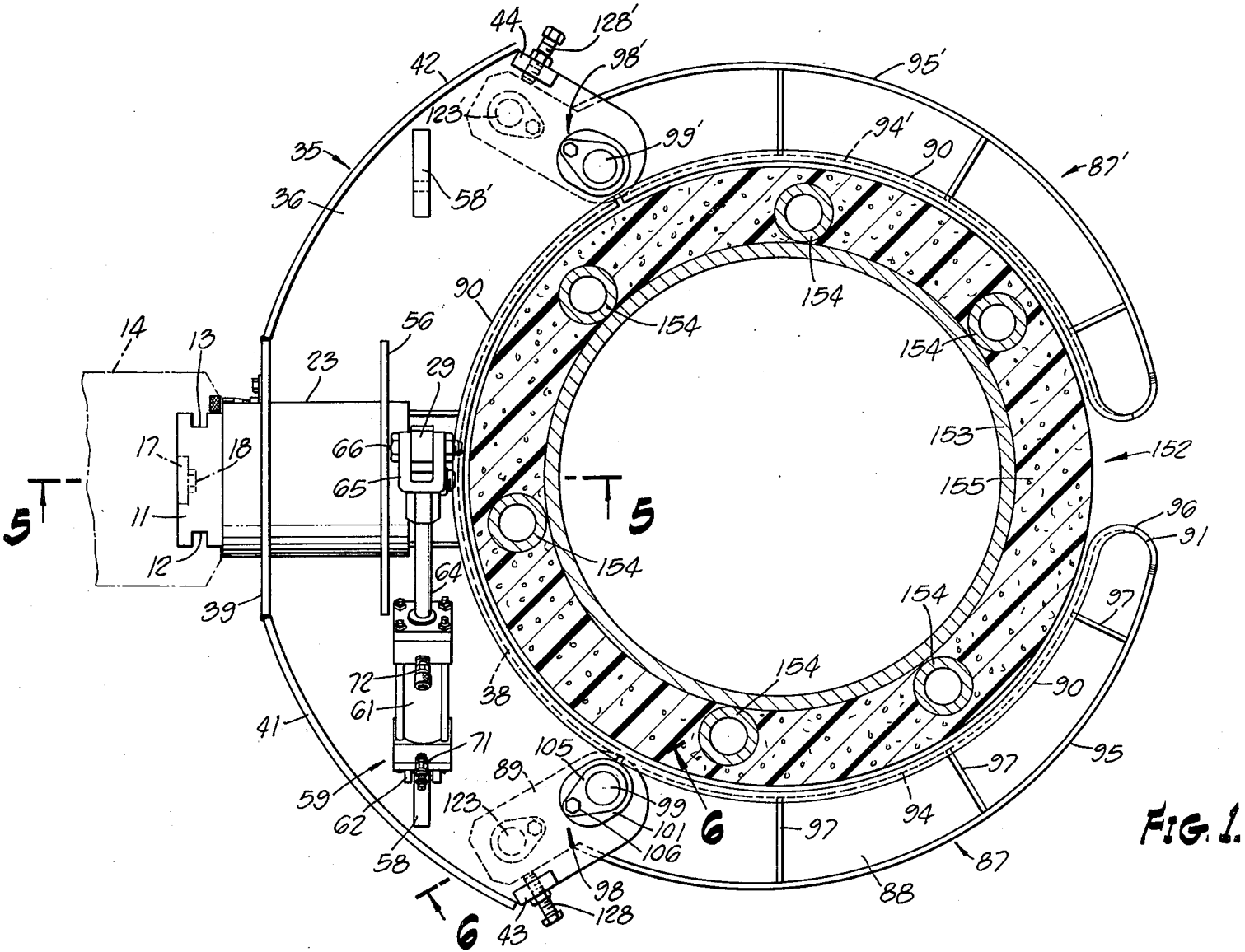
FIG. 1 is a plan view of an exemplary pipe handling head embodying the invention and showing, in transverse section, a length of riser pipe covered with flotation material and grasped by the head.
Figure 2:
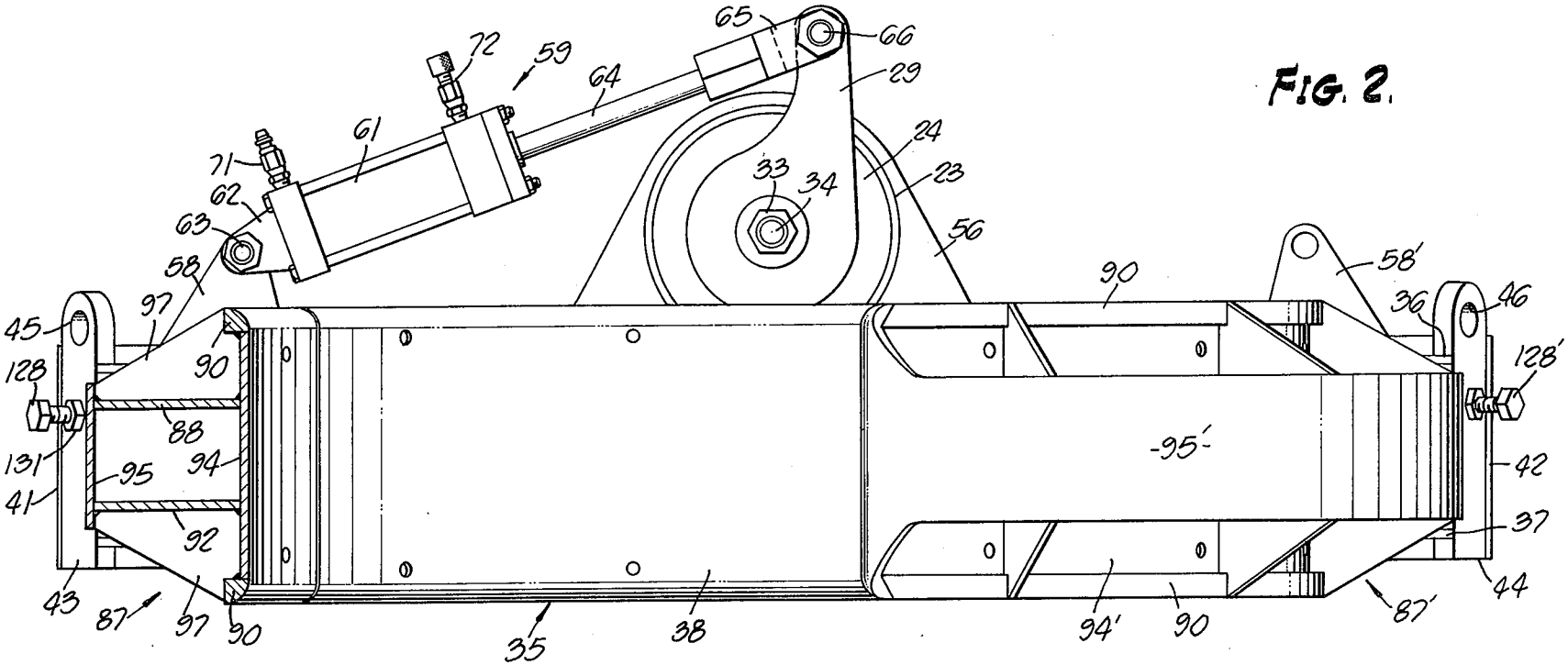
FIG. 2 is a front elevational view on an enlarged scale and partly in section, of the pipe handling head shown in FIG. 1.
Figure 5:
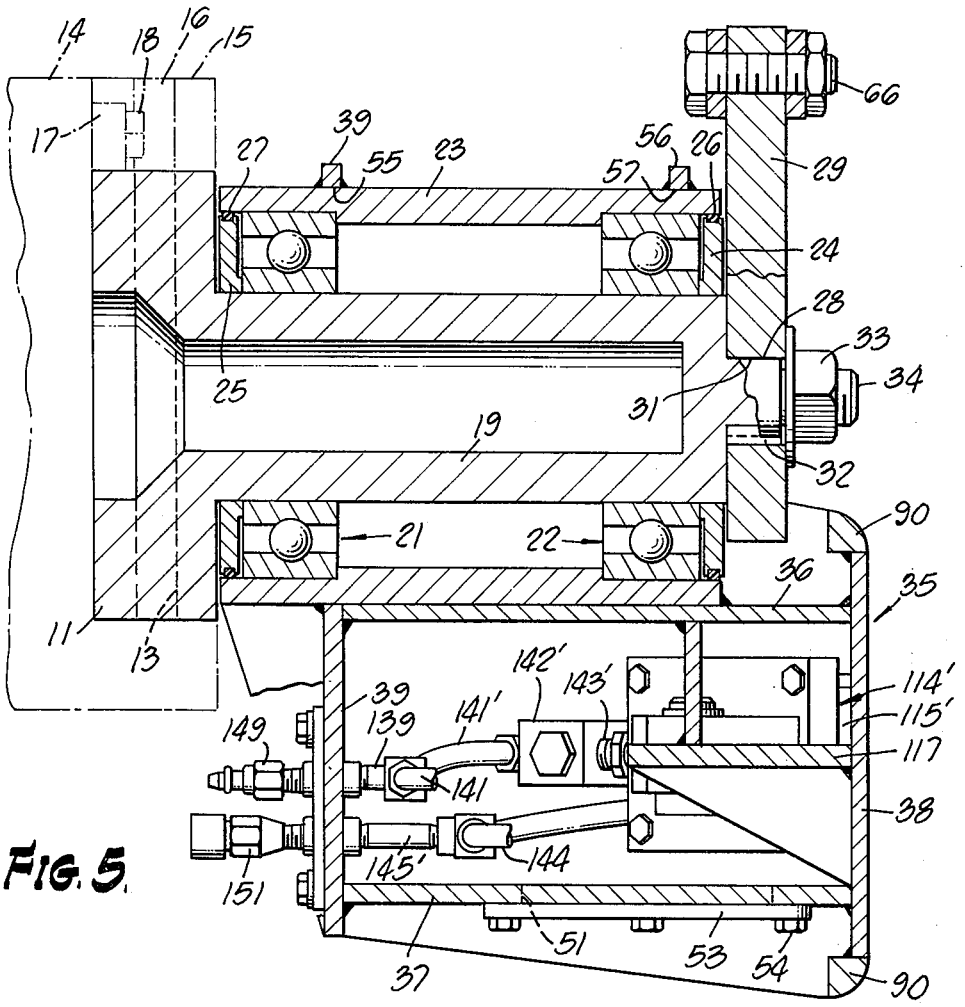
FIG. 5 is an enlarged sectional view taken along the line 5—5 of FIG. 1 and looking in the direction of the arrows.

Referring to the drawings, particularly to FIGS. 1, 2 and 5, the pipe handling and stabilizing head shown has a base 11 in the form of a rectangular plate. The base has grooves 12, 13 in its sides and is adapted to be mounted on the end of a movable arm 14, which may be like the arm of the lowermost pipe handling assembly of the Turner patent, previously mentioned. For this purpose, the arm 14 has a vertical recess 15 into which vertical ribs 16 project. The base 11 is slidably fitted into the recess from the top with the ribs 16 engaged in the grooves 12, 13. A stop 17, held in place by a machine screw 18, retains the base in the recess.

As best seen in FIG. 5, the base 11 has an integral bearing shaft 19. Radial-thrust bearings 21, 22 are mounted on the bearing shaft and rotatably support a cylindrical rotor 23. Annular bearing retainer assemblies 24, 25 are fixed to opposite ends of the bearing shaft. Seal rings 26, 27 are fitted into circumferential grooves in the outer peripheries of the bearing retainer assemblies. These seal rings cooperate with the rotor 23 to hold grease in and to keep dust out of the bearings. Grease fittings (not shown) may be provided for injecting grease into the bearings 21 and 22.

The bearing shaft 19 has an integral, coaxial stub shaft 28. An upstanding lever 29 which has a shaft hole 31 therethrough is fitted to the stub shaft. Key means 32 prevent the lever from rotating on the stub shaft. The lever is fastened to the stub shaft by a nut 33 screwed to the reduced and threaded end 34 of the stub shaft.

A body, designated by the general reference numeral 35, is attached to the rotor 23 for pivoting therewith. The body is of welded construction and has a top plate 36 of generally arcuate shape, a correspondingly shaped bottom plate 37, an arcuate front plate 38, and a back consisting of a flat central plate 39 and two arcuate side plates 41, 42. Vertical posts 43, 44 are welded to the ends of the body and are provided, respectively, with lifting holes 45, 46 for engagement by hoisting hooks (not shown).

Figure 4:
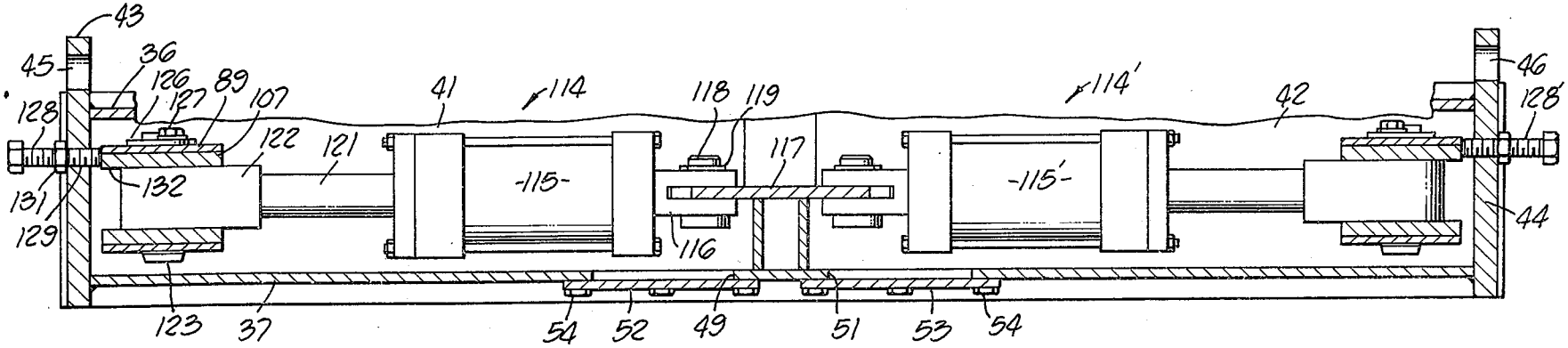
FIG. 4 is a sectional view taken on the line 4—4 of FIG. 3 and looking in the direction of the arrows.
Figure 3:
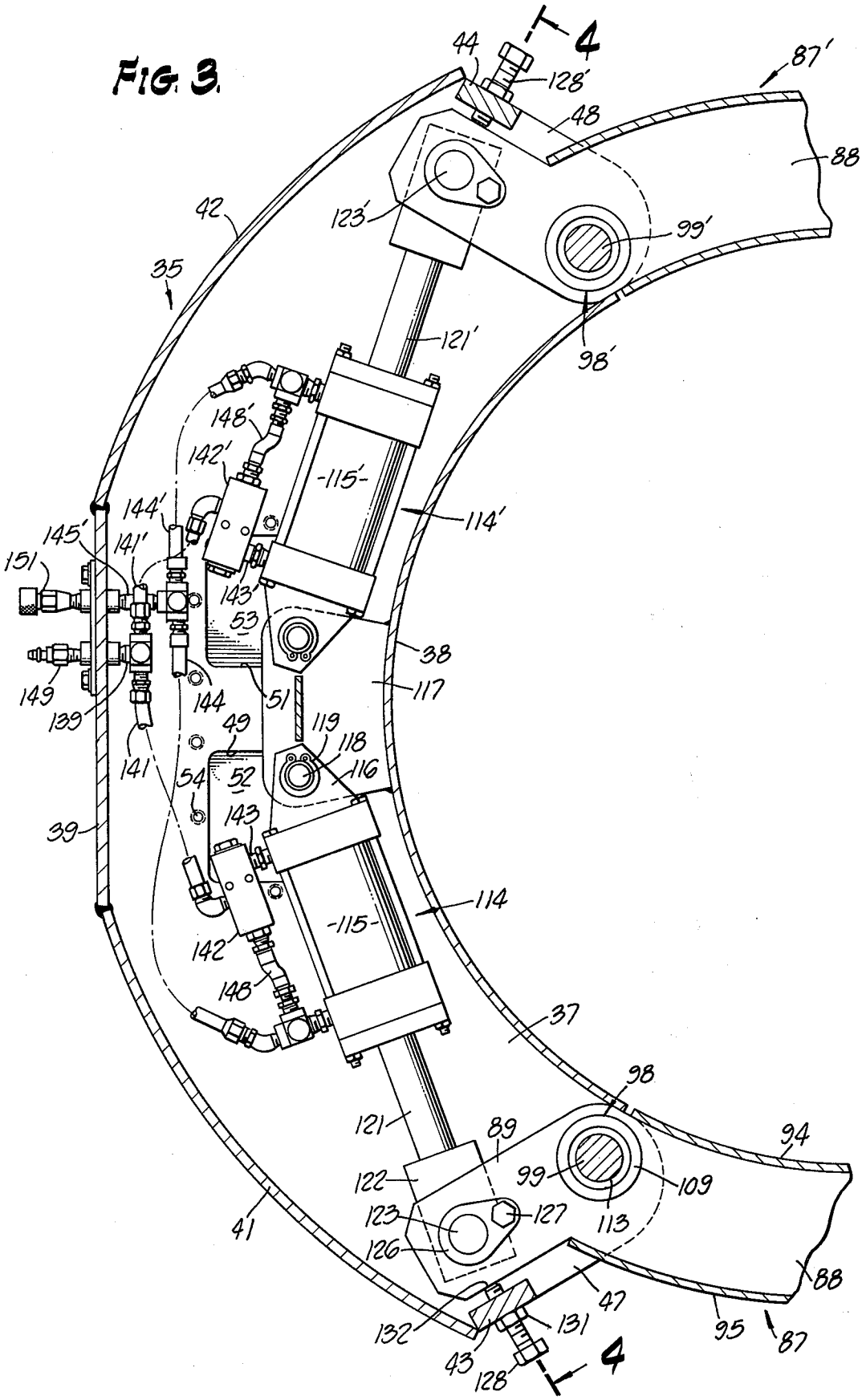
FIG. 3 is a fragmentary horizontal sectional view of the pipe handling head on the same scale as FIG. 2.

As best seen in FIG. 3, the opposite ends of the body are open to form windows 47 and 48. As shown in FIGS. 3, 4, and 5, the bottom plate has two access holes 49, 51 closed by cover plates 52, 53 removably fastened to the bottom plate by screws 54.

Referring again to FIGS. 1, 2 and 5, it is seen that the flat central back plate 39 extends above the top plate 36 and has a circular opening 55 providing a close fit with the rear end of the rotor 23, the plate being welded to the rotor around the opening. A connector plate 56, having a circular opening 57 providing a close fit with the front end of the rotor 23, is welded to the rotor and to the top plate 36. Thus, the back plate and the connector plate materially strengthen the joint between the rotor 23 and the body 35.

Figure 7:
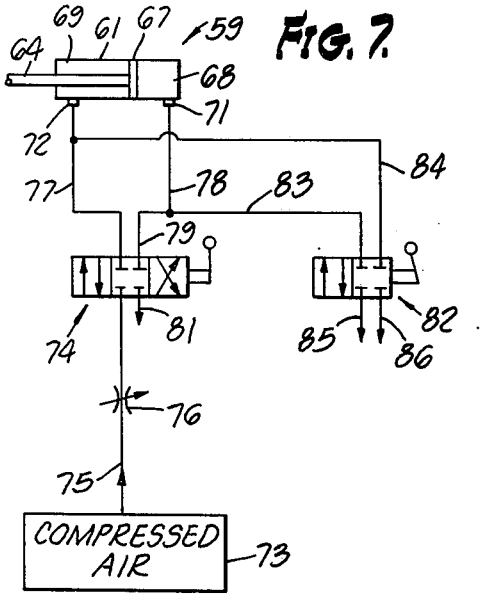
FIG. 7 is a schematic view of a power actuated means for rotating the body on its pivot.

From the description thus far, it is seen that the body 35 is pivotable about the axis of the shaft 19 and with respect to the base 11. Power actuated apparatus for pivoting the body will now be described with reference to FIGS. 1, 2 and 7. An upstanding cylinder mounting bracket 58 is welded to the top plate 36 of the body. An extensible and contractible pneumatic piston-cylinder device, designated by the general reference numeral 59, is mounted between the bracket 58 and the upper end of the lever 29, previously described. The device 59 has a cylinder 61 having a clevis 62 at its head end by which the cylinder is pivoted to the bracket 58 on a bolt 63. A longitudinally reciprocable piston rod 64 projects through the rod end of the cylinder, the end of the rod being provided with a clevis 65 pivotally attached to the upper end of the lever 29 by a bolt 66. As shown in FIG. 7, a piston 67 is carried by the end of the rod 64 that is within the cylinder, the piston being longitudinally slidable in the cylinder to extend and retract the rod. The piston and the cylinder define a chamber 68 at the head end of the cylinder and another chamber 69 at the rod end of the cylinder. As seen in FIGS. 1 and 2, a quick disconnect fitting 71, having an air passage therethrough, enables air to flow into and out of the head chamber 68. Another quick disconnect fitting 72, having an air passage therethrough, similarly provides for the flow of air into and out of the rod chamber 69.

Returning to FIG. 7, the piston-cylinder device 59 shown therein is extended and contracted by air under pressure from a source of compressed air 73. Air flow to an air valve 74 through a flow line 75 having an adjustable metering valve 76 therein. The air valve is shown in closed position. When shifted to the right, the air valve 74 directs air under pressure through a flow line 77 into the rod chamber 69 to move the piston and rod towards the head end of the cylinder. This forces air out of the head chamber 68 through a flow line 78, 79, through the valve 74, and through an exhaust line 81 to the atmosphere, all as indicated by arrows. In this way, the piston-cylinder device 59 is contracted to pivot the body 35.

To expand the piston-cylinder device for pivoting the body in the opposite direction, the valve 74 is shifted to the full left or reverse position, whereupon, air under pressure flows, in an obvious manner, from the source 73 into the head chamber 68, moving the piston to the left and forcing air out of the rod chamber to the atmosphere through exhaust line 81.

As seen in FIG. 7, an "on-off" air valve 82 is shown, which valve is in the closed position. This valve is connected by a flow line 83 to the flow line 78, 79, previously referred to, and is also connected by another flow line 84 to the flow line 77, previously mentioned.

It will be understood, from a consideration of FIG. 7, that the valve 82 remains closed when the piston-cylinder device 59 is actuated responsive to the valve 74, as described hereinbefore. With both valves 74 and 82 closed, air flow in and out of the cylinder chambers 68, 69 is blocked, so that the piston 67 tends to resist movement from external forces applied to it by the piston rod 64 and remains fixed, subject of course, to small cushioned movements allowed by the compression and expansion of the air in the closed system.

If the valve 82 is opened while the valve 74 is closed, the cylinder chamber 68 is opened to the atmosphere through the flow lines 78 and 83, and a flow line 85 that communicates with the atmosphere. The cylinder chamber 69, too, is open to the atmosphere through the flow lines 77 and 84, and another flow line 86 that communicates with the atmosphere. When the valves are set in these positions, the piston 67 is substantially unimpeded by blocked air, and is able to reciprocate freely responsive to movements imparted to it by the piston rod 64.

As clearly shown in FIGS. 1 and 2, an alternate cylinder mounting bracket 58' is provided on the opposite side of the body 35 from the hereinbefore described cylinder mounting bracket 58. Using the alternate bracket 58', the piston-cylinder device 59 and lever 29 can be reversed and mounted on the opposite side from that on which it is mounted as shown in FIGS. 1 and 2. The reversal is readily accomplished. First, the cylinder clevis 62 is unbolted from the bracket 58, and, after unthreading the nut 33 from the threaded end 34 of the stub shaft, the lever is removed from the stub shaft. Then, the clevis 62 is bolted to the alternate bracket 58' and the lever is positioned on the stub shaft and fastened thereto. The reversed position of the piston-cylinder device may be employed when the pipe handling head is located on the opposite side of the pipe being operated upon, or when the pipe is brought into the derrick from the opposite side.

Referring to FIGS. 1, 2, 3 and 6, the pipe handling head shown is seen to have a pair of arcuate latch arms 87, 87', that are pivotally mounted, by pivot devices 98, 98', at proximal ends to opposite ends of the body 35. The latch arms are weldments and are mirror images of one another. The latch arm 87 has an arcuate top plate 88. As seen in FIG. 3, the top plate has an angularly offset lever portion 89. The free or distal end 91 of the top plate is rounded (see FIG. 1). The arm has a bottom plate 92 that is identical in outline to the top plate, and has an angularly offset lever portion 93. The arm has a vertical inside plate 94 of the same height and curvature as the front plate 38 of the body 35. The arm also has a vertical outside plate 95. The inside and outside plates are curved around the distal end 91 and welded together at 96. Gusset plates 97 add rigidity and strength to the latch arm. Quarter-round molding strips 90 are welded along the top and bottom edges of the lever arms 87 and 87', as well as along the top and bottom edges of the front plate 38 of the body 35, for a purpose that will be explained hereinafter.

The latch arms 87, 87' are pivoted to the body 35 by the respective pivot devices 98 and 98', which are identical. The pivot device 98 will now be described with particular reference to FIGS. 1, 3 and 6. A pivot pin 99 is stationarily mounted between the top and bottom plates 36, 37. A mounting plate 101 is welded to the top plate and a similar mounting plate 102 is welded to the bottom plate. Aligned holes 103, 104 receive the pin. A retainer plate 105 is welded to the pin near its top, and the pin and retainer plate are releasably fastened to the mounting plate 101 by a machine screw 106.

Figure 6:
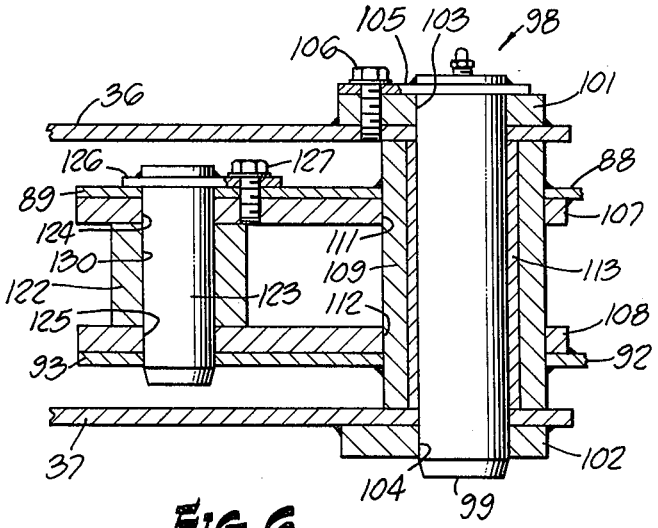
FIG. 6 is an enlarged sectional view taken along the line 6—6 of FIG. 1 and looking in the direction of the arrows.

As best seen in FIG. 6, other mounting plates 107, 108 are welded, respectively, to the top and bottom plates 88, 92 of the latch arm 87. A bearing sleeve 109 is received in holes 111,112 and secured 111, 112 by welding. A bearing 113 is carried by the sleeve 109 and is rotatable on the pivot pin 99.

Power apparatuses, designated generally as 114, 114' for pivoting the respective lever arms 87, 87', will now be described with particular reference to FIGS. 3, 4, 6 and 8. The power apparatuses are hydraulically powered and are mirroor imags of each other.

Power apparatus 114, which is typical of power apparatus 114', has a hydraulic cylinder 115, having a clevis 116 at its head end. A bracket 117 is welded to the body 35. The clevis is pivoted to the bracket by a headed pin 118 that passes through holes in the bracket and the clevis and is retained therein by a snap ring 119. A piston pin 121 projects from the other end of the cylinder and is provided with a knuckle 122 at its outer end. The knuckle is pivotally connected to the lever portions 89, 93 of the latch arm 87. This pivotal connection is best seen in FIG. 6. A pivot pin 123 is fixedly supported by the lever arm portions 89, 93. The pin is disposed in holes 124, 125 in the lever arm portions and the mounting plates 107, 108, and is retained in the holes by a retainer plate 126 welded to the pin and releasably fastened to the lever arm portion 89 by a screw 127. The pin is pivotally disposed in a hole 130 in the knuckle 122. It will thus be seen that retraction of the piston rod 121 into the cylinder 115 will swing the latch arm 87 clockwise from its closed position illustrated in FIG. 3 to an open position. The latch is returned to closed position upon extension of the piston rod from the cylinder.

The closed position of the latch arm is determined by stop means, which as shown are adjustable. Such stop means, best seen in FIGS. 3 and 4, include a screw 128 which is threaded through a tapped hole 129 in the post 43 and provided with a lock nut 131. The screw has an inner end 132 positioned to be contacted by the lever arm portion 89 and mounting plate 107 of the latch arm 87 to limit its pivotal movement in the closing direction. The screw may be adjusted to vary the position of the latch arm 87 with respect to the body 35 in the fully closed position of the latch arm.

Figure 8:
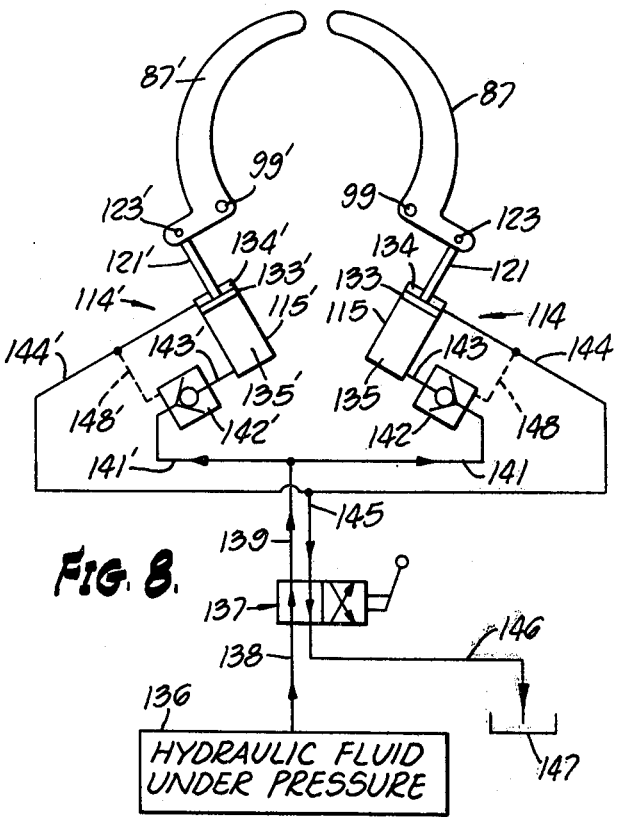
FIG. 8 is a schematic view showing power actuated means for pivoting the latch arms.

The hydraulic power apparatuses 114, 114' for swinging the latch arms between closed and open positions will now be further described with reference to FIG. 8. The inner end of piston rod 121 is attached to a piston 133 that is longitudinally reciprocable in the cylinder 115, thus providing a double acting hydraulic piston-cylinder device that is extensible to close the latch arm 87 and contractible to open it. The piston and cylinder provide a rod chamber 134 and a head chamber 135. Hydraulic fluid for actuating the piston-cylinder device is supplied from a source 136 of hydraulic fluid under pressure. Operation of the piston-cylinder device is controlled by a hydraulic valve 137. When the valve is set to the right, as shown in FIG. 8, hydraulic fluid flows, as indicated by the arrows, from the source 136 through a flow line 138, through the valve 137, through another flow line 139, through a branch flow line 141, through a pilot check valve 142, through yet another flow line 143, and into the head chamber 135 of the piston-cylinder device. Thereby, the piston 133 is moved to extend the piston rod 121 from the cylinder and move the latch arm 87 to closed position. Such piston movement forces hydraulic liquid from the rod chamber 134 through a flow line 144 into a connecting flow line 145, through the valve 137, and through a discharge line 146 into a sump 147.

In the event of a loss of power for pressurizing the hydraulic fluid or a rupture or other failure of hydraulic fluid flow lines in advance of the pilot check valve 142, the check valve will remain closed keeping pressure in the head chamber 135 and maintaining the latch arm 87 in closed position.

To pivot the latch arm 87 from closed to open position, the hydraulic valve 137 is shifted to the left, as seen in FIG. 8, to reverse the flow of pressurized hydraulic fluid, whereby fluid flows from the source 136 into the rod chamber 134, and from the head chamber 135 into the sump 147. Thus, the piston rod 121 is retracted and the latch arm 87 pivoted to open position. In this mode of operation, the pilot check valve 142 is opened in response to fluid pressure in the flow line 144 to permit fluid to flow from the head chamber 135 through the pilot check valve for discharge into the sump. The pressure for so actuating the check valve is applied to it from the flow line 144 through a pilot valve control line 148. Since such a pilot valve is well known per se and commercially available, it is believed to be unnecessary to describe it in further detail herein.

It is evident from FIG. 8 that the power apparatus 114' operates in conjunction with and in the same manner as the power apparatus 114 hereinbefore described to move the opposed latch arm 87' simultaneously with the latch arm 87 from closed to open positions and vice versa.

The hydraulic fluid flow lines and pilot check valves shown in FIG. 3 are designated by the same reference numerals as their counterparts in FIG. 8. It will be observed that the hydraulic valve 137 shown in FIG. 8 does not appear in FIG. 3, and it will be understood that this valve can be connected to quick disconnect fittings designated 149 and 151 in FIG. 3.

The operation of the head shown in FIGS. 1 to 8 should be, in large measure, evident from the foregoing description. However, a further description of such operation will now be given.

Referring to FIG. 1, it is seen that the latch arms 87, 87' are in closed positions and disposed about a length of marine riser pipe, denoted by the general reference numeral 152. The length of riser pipe includes a metallic riser pipe proper 153. A plurality of control lines 154, six being shown by way of example, are disposed longitudinally along and spaced circumferentially about the exterior of the riser pipe proper. The riser pipe proper and the control lines are encased in an annular cylindrical body of flotation material 155. This material is a very light weight, foamed, solid material that adds buoyancy to the riser and also cushions and protects the control lines from impacts. It is seen that the stop screws 128, 128' are so adjusted that the latch arms 87, 87' are not closed tightly upon the flotation material, but are spaced somewhat from it so that the length of riser pipe 152 may turn and also slide longitudinally in the head. The molding strips 90 at the top and bottom edges of the inside plates 94, 94' of the latch arms, and at the top and bottom of the front plate 38 of the body, present rounded surfaces over which the flotation material can ride without danger of being cut as the length of riser pipe 152 moves in the head.

When the head has been closed about a length of riser pipe, and the supporting arm 14 is being moved to guide the bottom of the length of suspended riser pipe to the desired position, the valves 74 and 82 (FIG. 7) are positioned so that the piston 67 is not restrained, thus allowing the latch arms, the body and the rotor to turn on the shaft 19 and adapt the angle of the head to the changing slant of the length of riser pipe.

When the bottom of the riser pipe has been positioned as desired, the latch arms are pivoted to their open positions by actuation of the hydraulic valve 137 (FIG. 8). In the open position, the distal ends of the latch arms are spaced apart wide enough to pass the pipe as the movable arm 14 is backed away. With the valves 74 and 82 set to allow the head to pivot freely, the head will settle into a horizontal position of rest, owing to the symmetrical configuration of the body and latch arms about the axis of the pivot pin 19 and their low center of gravity.

To grasp a length of riser pipe, the head, with the latch arms in their open positions, is rotated by manipulation of the valves 74 and 82 (FIG. 7) to an angle corresponding to the angle of the pipe length, and held at this angle while the movable arm 14 is actuated to place the head around the length of pipe. Then, the latch arms are closed (valve 137, FIG. 8) about the length of pipe, and the piston-cylinder device 59 (FIG. 7) is conditioned to allow free movement of the piston 67. The length of pipe may then be steadied and guided into place by manipulation of the movable arms 14.

Should a loss of pressure occur in the hydraulic flow lines ahead of the pilot check valves 142, 142', the latch arms will remain closed about the riser pipe, due to maintenance of hydraulic fluid pressure in the head chambers 135, 135' by action of the check valves.

Figure 9:
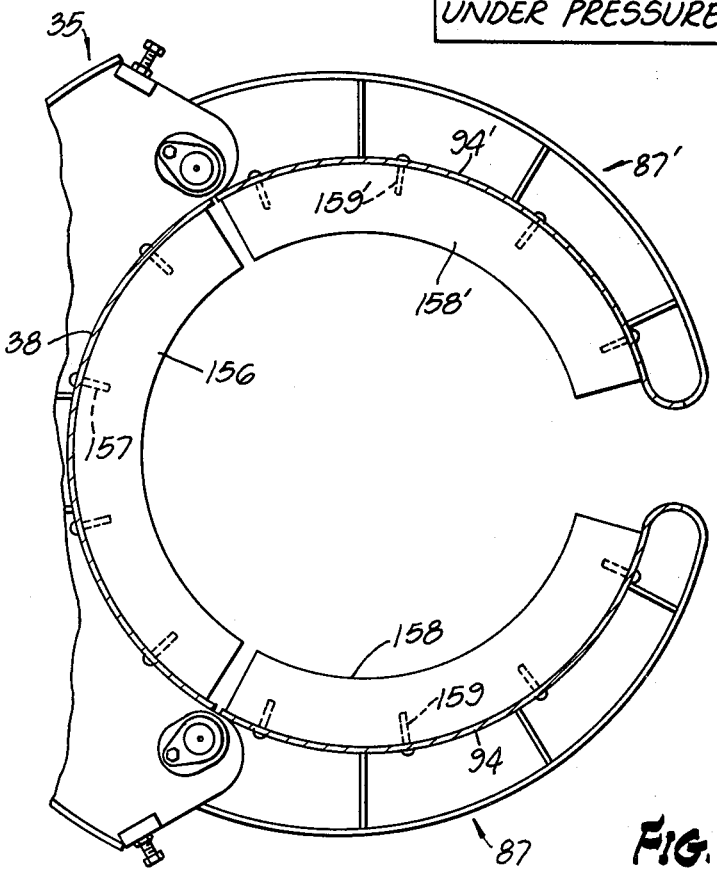
FIG. 9 is a fragmentary plan view of a modified form of pipe handling head in accordance with the invention.

Referring to FIG. 9, the modified head shown therein is like the head described hereinbefore. However, the head of FIG. 9 is modified for the handling of riser pipe lengths like that shown in FIG. 1, but without the annular cylindrical body of flotation material 155. As shown in FIG. 9, an arcuate pad 156 of cushioning material is attached by fasteners 157 to the front plate 38 of the body 35. Similar arcuate pads 158, 158' are attached to the inside plates 94, 94' of the latch arms 87, 87' by other fasteners 159, 159'. The cushioning material may be the same as the flotation material 155, previously described. It is a lightweight, foamed, springy substance that yields and conforms to the control lines extending along the outside of the metallic riser pipe proper, and thereby protects the control lines from damage which would otherwise occur in the absence of the cushioning pads.

Whereas, two forms of riser handling heads have been disclosed herein, it will be understood that these are but exemplary, and that the scope of the invention is defined in the claims, which are to be interpreted as broadly as the prior art permits. In the light of the foregoing description, various changes will occur to persons skilled in the art without departing from the claimed invention.

I claim:

1. A head for grasping and guiding a length of pipe which comprises:

a base, a body, first pivot means for pivotally mounting said body on said base, first power actuated means for pivoting said body on said first pivot means, a pair of latch arms, each having a proximal end and a distal end, other pivot means for mounting said latch arms by their proximal ends on said body in opposed relation to one another for pivotal movements between closed positions, in which said latch arms are disposed to define a substantial portion of an opening for the reception of a length of pipe and to retain the length of pipe in the opening against lateral movement out of the opening, and open positions, in which the distal ends of said latch arms are separated to permit the length of pipe to pass laterally from said opening through the space between the distal ends of said pair of latch arms, and second power actuated means for pivoting said latch arms between said open and closed positions, wherein said second power actuated means for pivoting said latch arms comprises:

a pair of double acting hydraulic piston-cylinder means extensible and contractible responsive to hydraulic fluid pressure, one of said pair of piston-cylinder means being operatively associated with one of said latch arms and adapted upon extension to move said one latch arm to a closed position and upon contaction to move said one latch arm to an open position, the other of said pair of piston-cylinder means being associated with the other of said latch arms and adapted upon extension to move said other latch arm to a closed position and upon contraction to move said other latch arm to an open position, first hydraulic fluid conduit means for simultaneously supplying hydraulic fluid pressure to said pair of piston-cylinder means to extend them, second hydraulic fluid conduit means for simultaneously supplying hydraulic fluid pressure to said pair of piston-cylinder means to contract them, and pilot check valve means in said first conduit means closable for maintaining hydraulic fluid pressure in said pair of piston-cylinder means to hold said pair of piston-cylinder means extended, including means responsive to hydraulic fluid pressure in said second conduit means for opening said pilot check valve means for relieving said hydraulic fluid pressure in said pair of piston-cylinder means so that said pair of piston-cylinder means can be contracted.

2. A head for grasping and guiding a length of pipe as defined in claim 1 comprising, cooperating stop members on said latch arms and on said body for stopping said latch arms in said closed positions.

3. A head for grasping and guiding a length of pipe as defined in claim 2, wherein said stop members are adjustable to vary the closed positions of said latch arms.

4. A head for grasping and guiding a length of pipe as defined in claim 1 comprising: arcuate lightweight, springy cushion means on said latch arms and within said opening.

5. A head for grasping and guiding a length of pipe which comprises:

a base, a body, first pivot means for pivotally mounting said body on said base, first power actuated means for pivoting said body on said first pivot means, a pair of latch arms, each having a proximal end and a distal end, other pivot means for mounting said latch arms by their proximal ends on said body in opposed relation to one another for pivotal movements between closed positions, in which said latch arms are disposed to define a substantial portion of an opening for the reception of a length of pipe and to retain the length of pipe in the opening against lateral movement out of the opening, and open positions, in which the distal ends of said latch arms are separated to permit the length of pipe to pass laterally from said opening through the space between the distal ends of said pair of latch arms, and second power actuated means for pivoting said latch arms between said open and closed positions, wherein said first power actuated means for pivoting said body on said first pivot means comprises:

a double-acting pneumatic piston-cylinder means operatively associated with said body and adapted upon extension to rotate said body in one direction and upon contraction to rotate said body in the opposite direction, said piston-cylinder means having a head chamber and a rod chamber on opposite sides of its piston, said chambers when pressurized respectively effecting said extension and contraction, first conduit means including first valve means selectively operable to admit pressurized gas to one of said chambers while permitting gas simultaneously to be exhausted from the other of said chambers, to admit pressurized gas to said other of said chambers while permitting gas simultaneously to be exhausted from said one chamber, and to block the flow of gas from both said chambers, and second conduit means including second valve means selectively operable to simultaneously open both said chambers to atmosphere and to simultaneously isolate both said chambers from atmosphere.

6. A head for grasping and guiding a length of pipe as defined in claim 5, comprising metering valve means in said first conduit means.

7. A head for grasping and guiding a length of pipe as defined in claim 5, wherein said double-acting pneumatic piston-cylinder means includes means connecting one end of said piston-cylinder means to said base and means connecting the other end of said piston-cylinder means to said body at one side thereof.

8. A head for grasping and guiding a length of pipe as defined in claim 7, comprising means for optionally connecting said other end of said piston-cylinder means to said body at the opposite side thereof.

9. A head for grasping and guiding a length of pipe as defined in claim 5, wherein the center of mass of said head, exclusive of said base, is substantially offset from and substantially directly beneath the axis of said first pivot means when said latch arms are horizontal, and said body and said latch arms are substantially symmetrical with respect to said center of mass.

10. A head for grasping and guiding a length of pipe which comprises:

a base, a body, first pivot means for pivotally mounting said body on said base, first power actuated means for pivoting said body on said first pivot means, a pair of latch arms, each having a proximal end and a distal end, other pivot means for mounting said latch arms by their proximal ends on said body in opposed relation to one another for pivotal movements between closed positions and open positions, and second power actuated means for pivoting said latch arms between said open and closed positions, wherein said second power actuated means for pivoting said latch arms comprises:

a pair of double acting hydraulic piston-cylinder means, one of said pair of piston-cylinder means being operatively associated with one of said latch arms and adapted to move said one latch arm between a closed position and an open position, the other of said pair of piston-cylinder means being associated with the other of said latch arms and adapted to move said other latch arm between a closed position and an open position, first hydraulic fluid conduit means for simultaneously supplying hydraulic fluid pressure to said pair of piston-cylinder means to cause them to pivot said latch arms to closed positions, second hydraulic fluid conduit means for simultaneously supplying hydraulic fluid pressure to said pair of piston-cylinder means to cause them to pivot said latch arms to open positions, and pilot check valve means in said first conduit means for maintaining hydraulic fluid pressure in said pair of piston-cylinder means, including means responsive to hydraulic fluid pressure in said second conduit means for opening said pilot check valve means.

11. A head for grasping and guiding a length of pipe as defined in claim 10 comprising, cooperating stop members on said latch arms and on said body for stopping said latch arms in said closed positions.

12. A head for grasping and guiding a length of pipe as defined in claim 11, wherein said stop members are adjustable to vary the closed positions of said latch arms.

13. A head for grasping and guiding a length of pipe as defined in claim 10 comprising: arcuate, lightweight, springy cushion means on said latch arms and within said opening.

14. A head for grasping and guiding a length of pipe which comprises:

a base, a body, first pivot means for pivotally mounting said body on said base, first power actuated means for pivoting said body on said first pivot means, a pair of latch arms, each having a proximal end and a distal end, other pivot means for mounting said latch arms by their proximal ends on said body in opposed relation to one another for pivotal movements between closed positions and open positions, and second power actuated means for pivoting said latch arms between said open and closed positions, wherein said first power actuated means for pivoting said body on said first pivot means comprises:

a double-acting pneumatic piston-cylinder means operatively associated with said body and adapted to rotate said body in opposite directions, said piston-cylinder means having a head chamber and a rod chamber on opposite sides of its piston, said chambers when respectively pressurized effecting rotation of said body in opposite directions, first conduit means including first valve means selectively operable to admit pressurized gas to one of said chambers while permitting gas simultaneously to be exhausted from the other of said chambers, to admit pressurized gas to said other of said chambers while permitting gas simultaneously to be exhausted from said one chamber, and to block the flow of gas from both said chambers, and second conduit means including second valve means selectively operable to simultaneously open both said chambers to atmosphere and to simultaneously isolate both said chambers from atmosphere.

15. A head for grasping and guiding a length of pipe as defined in claim 14, comprising metering valve means in said first conduit means.

16. A head for grasping and guiding a length of pipe as defined in claim 14, wherein said double-acting pneumatic piston-cylinder means includes means connecting one end of said piston-cylinder means to said base and means connecting the other end of said piston-cylinder means to said body at one side thereof.

17. A head for grasping and guiding a length of pipe as defined in claim 16, comprising means for optionally connecting said other end of said piston-cylinder means to said body at the opposite side thereof.

18. A head for grasping and guiding a length of pipe as defined in claim 14, wherein the center of mass of said head, exclusive of said base, is substantially offset from and substantially directly beneath the axis of said first pivot means when said latch arms are horizontal, and said body and said latch arms are substantially symmetrical with respect to said center of mass.

19. A head for grasping and guiding a length of pipe which comprises:

a base, a body, first pivot means for pivotally mounting said body on said base, first power actuated means for pivoting said body on said first pivot means, a pair of latch arms, each having a proximal end and a distal end, other pivot means for mounting said latch arms by their proximal ends on said body in opposed relation to one another for pivotal movements between closed positions and open positions, and second power actuated means for pivoting said latch arms between said open and closed positions, wherein said second power actuated means for pivoting said latch arms comprises:

double acting hydraulic piston-cylinder means operatively associated with said latch arms and adapted to move said latch arms between closed positions and open positions, first hydraulic fluid conduit means for supplying hydraulic fluid pressure to said piston-cylinder means to cause the latter to pivot said latch arms to closed positions, second hydraulic fluid conduit means for supplying hydraulic fluid pressure to said piston-cylinder means to cause the latter to pivot said latch arms to open positions, and pilot check valve means in said first conduit means for maintaining hydraulic fluid pressure in said piston-cylinder means, including means responsive to hydraulic fluid pressure in said second conduit means for opening said pilot check valve means.

* * * * *